US009302806B2

(12) United States Patent
Perkins

(10) Patent No.: US 9,302,806 B2
(45) Date of Patent: Apr. 5, 2016

(54) COLLAPSIBLE CONTAINER WITH IMPROVED CORNERS

(71) Applicant: David W. Perkins, Cedar Rapids, IA (US)

(72) Inventor: David W. Perkins, Cedar Rapids, IA (US)

(73) Assignee: Paper Systems, Inc., Des Moines, IA (US)

( * ) Notice: Subject to any disclaimer, the term of this patent is extended or adjusted under 35 U.S.C. 154(b) by 81 days.

(21) Appl. No.: 14/102,888

(22) Filed: Dec. 11, 2013

(65) Prior Publication Data

US 2015/0158625 A1 Jun. 11, 2015

(51) Int. Cl.

| | |
|---|---|
| ***B64D 5/00*** | (2006.01) |
| ***B65D 5/42*** | (2006.01) |
| ***B65D 5/12*** | (2006.01) |
| ***B65D 5/02*** | (2006.01) |
| ***B65D 77/06*** | (2006.01) |

(52) U.S. Cl.

CPC ..... *B65D 5/4266* (2013.01); *B65D 5/02* (2013.01); *B65D 5/12* (2013.01); *B65D 77/061* (2013.01)

(58) Field of Classification Search

CPC ..... B65D 77/061

See application file for complete search history.

(56) References Cited

U.S. PATENT DOCUMENTS

| | | | | |
|---|---|---|---|---|
| 1,758,230 | A * | 5/1930 | Lange | 428/154 |
| 2,949,151 | A * | 8/1960 | Goldstein | 156/209 |
| 4,601,407 | A * | 7/1986 | Gillard | 229/125.19 |
| 4,693,413 | A * | 9/1987 | McFarland et al. | 229/122.32 |
| 5,279,423 | A * | 1/1994 | Shuert | 206/600 |
| 7,172,108 | B2 * | 2/2007 | Ingalls | 229/117.33 |
| 7,604,156 | B2 * | 10/2009 | Clohessy | 229/122.32 |
| 2001/0027992 | A1 * | 10/2001 | Strong | 229/117.01 |
| 2006/0169757 | A1 * | 8/2006 | McDowell | 229/122.33 |

FOREIGN PATENT DOCUMENTS

| | | | | |
|---|---|---|---|---|
| EP | 149889 | A2 * | 7/1985 | B65D 5/4266 |

* cited by examiner

*Primary Examiner* — Gary Elkins
(74) *Attorney, Agent, or Firm* — Brett J. Trout

(57) ABSTRACT

A collapsible container having thick corrugated walls with double crease corners. The double crease corners define two 45° angles instead of one 90° to allow the container to maintain a generally rectangular shape and reduce the tendency of the side panels to bias outward when the container is filled with a flowable material.

20 Claims, 6 Drawing Sheets

COLLAPSIBLE CONTAINER WITH IMPROVED CORNERS

TECHNICAL FIELD

The disclosed embodiments relate generally to bulk containers for flowable materials and, in particular, to bulk containers having improved corners.

BACKGROUND OF THE INVENTION

Cylindrical containers, such as drums, do not maximize floor and pallet space for storage and transport. It would be desirable to provide a container in a rectangular shape to maximize storage of material on the footprint of a standard pallet.

Conventional rigid containers, such as drums, for the storage and transportation of flowable or fluid materials are bulky and heavy even when not in use. It would therefore be desirable to provide a lightweight container constructed of cardboard or the like. One drawback associated with the use of cardboard is the tendency of cardboard to deform from a rectangular cross section toward a circular cross section.

It is known to provide reinforcements to prevent such deformation, but reinforcements can be complex, heavy, and expensive. It is also known to provide the container with additional layers of cardboard to increase the strength of the container. One drawback associated with cardboard containers having increased layers is the difficulty associated with bending the increased thickness of the container into a stable corner. The additional thickness of the material prevents the formation of a sharp corner, causing the material to bias the corner toward a more rounded corner.

It is also known to remove material in a generally v-shape to facilitate the bending of the material to create a corner. One drawback associated with removing material is the weakness of the resulting corner associated with the reduction in material.

Another drawback associated with removing material is the additional time and expense associated with removing the material.

Yet another drawback associated with the removal of material to form a corner is the precision required to provide the desired corner without removing too much material and leaving the corner subject to failure.

It is also known in the art to crease the material to form a corner. While such a crease may work for cardboard structures having a thinner sidewall, for thicker containers having three or more layers of corrugation, it is often difficult to provide a crease sufficient to create a corner that does not bias toward an open, rounded, and weaker orientation. It would therefore be desirable to provide a lightweight, flexible container having increased wall thickness with a corner that is strong and that resists bias toward an open configuration.

SUMMARY OF THE DISCLOSED SUBJECT MATTER

The present invention includes a collapsible container having four side panels that are at least triple corrugated. The corners of the container are each provided with a first crease and a second crease to create a corner having a first substantially flat side and a second side defining a peak. The features and advantages described in the summary and the following detailed description are not all-inclusive. Many additional features and advantages will be apparent to one of ordinary skill in the art in view of the drawings, specification, and claims presented herein.

BRIEF DESCRIPTION OF THE DRAWINGS

The present invention will now be described, by way of example, with reference to the accompanying drawings in which.

DETAILED DESCRIPTION OF THE DRAWINGS

Figure 1:
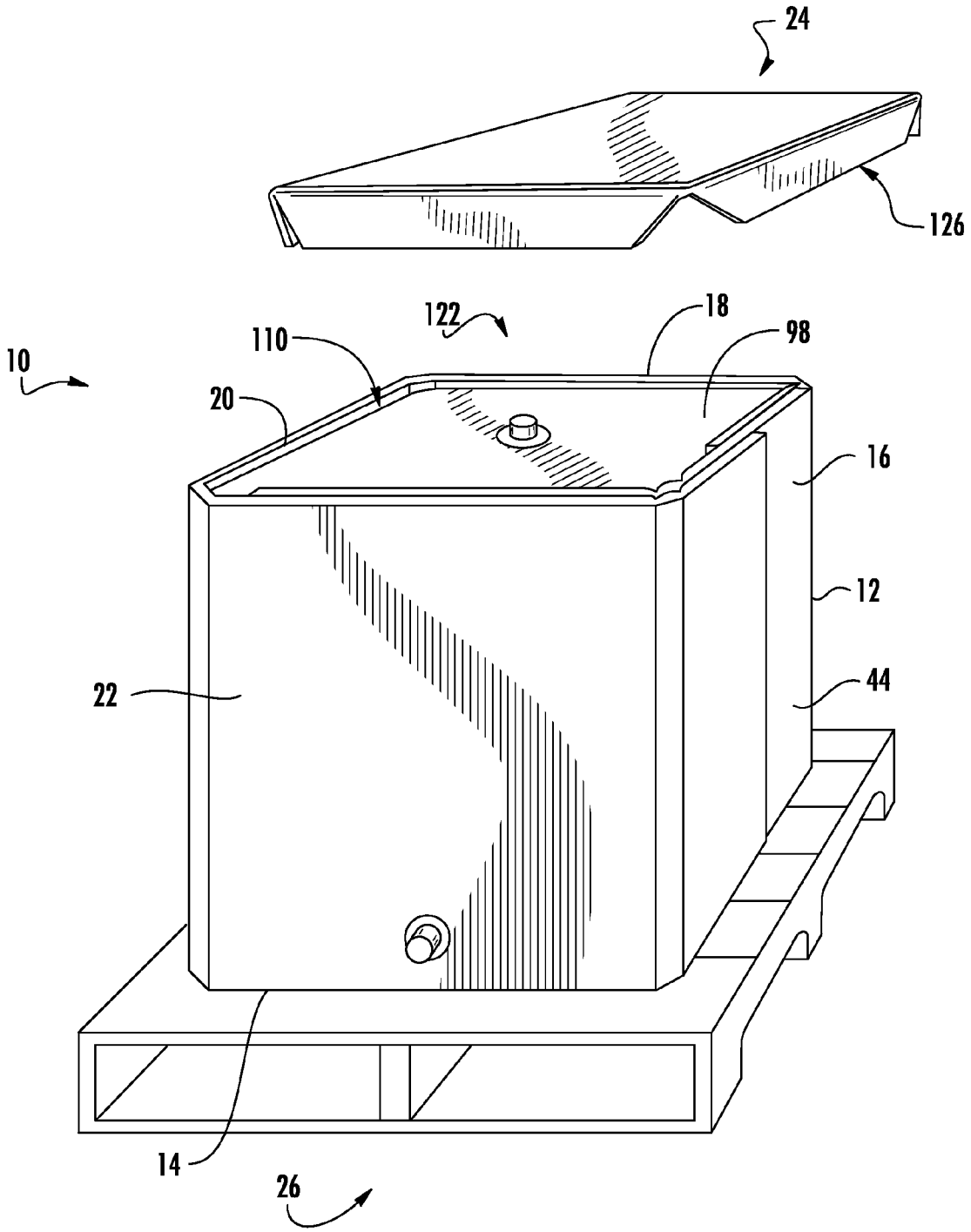
FIG. 1 illustrates a side perspective elevation in accordance with one embodiment.

A collapsible container for containing flowable materials is shown generally as 10 in FIG. 1. As shown, the container 10 includes an outer liner 12 having a bottom 14 and a first side panel 16, a second side panel 18, a third side panel 20, a fourth side panel 22, and a lid 24. Although the outer liner 12 may be of any suitable dimensions, in the preferred embodiment, the bottom 14 is dimensioned to fit on a standard 48" long and 40" wide stringer pallet 26. Preferably, the bottom 14 and side panels 16, 18, 20, 22 of the outer liner 12 are constructed of two sheets of triple-sided corrugated cardboard, such as that known in the art, secured together to create a thickness of six corrugations.

Figure 2:
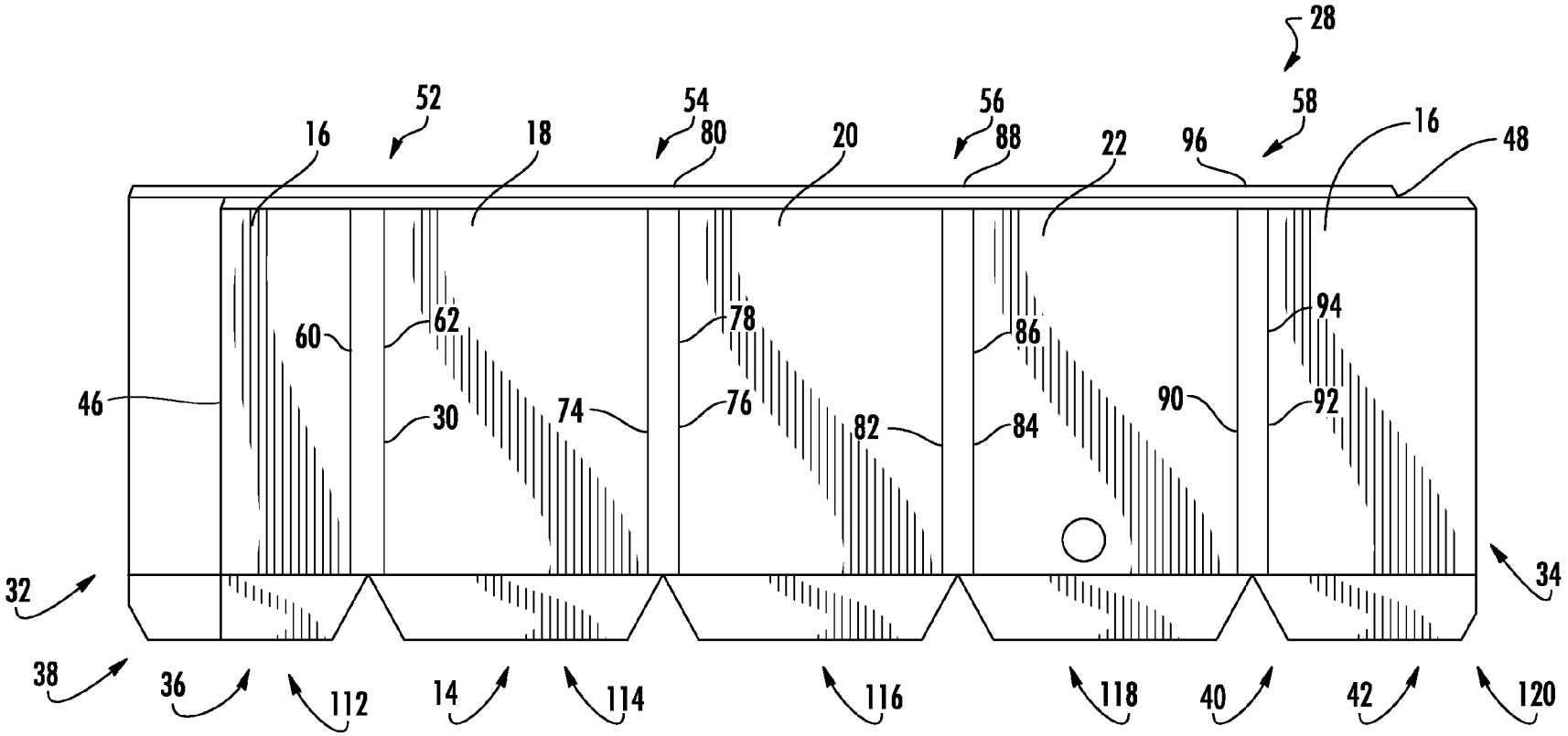
FIG. 2 illustrates a side elevation showing the side panels and bottom of the container of FIG. 1 prior to assembly.

As shown in FIG. 2, a long sheet 28 of such cardboard is die cut in the configuration shown and provided with a plurality of creases 30 to create the bottom 14 and side panels 16, 18, 20, 22. In the long sheet 22, the first side panel 16 is divided into a first part 32 and second part 34. The first part 32 is further divided into a thick portion 36 and a thin portion 38. The thick portion 36 is preferably slightly smaller than half the width of the remaining side panels 18, 20, 22, and the thin portion is slightly smaller, being approximately 10 cm in width in the preferred embodiment. The thick portion 36 of the first part 32 of the first panel 16 is of the same thickness as the other side panels 18, 20, 22, namely, six corrugations. The thin portion 38, however, is half that thickness, being only three corrugations in thickness. The thin portion 38 of the first part 32 of the first panel 16 is merely an extension of the back of the corrugation of the long sheet 28 of cardboard.

Figure 3:
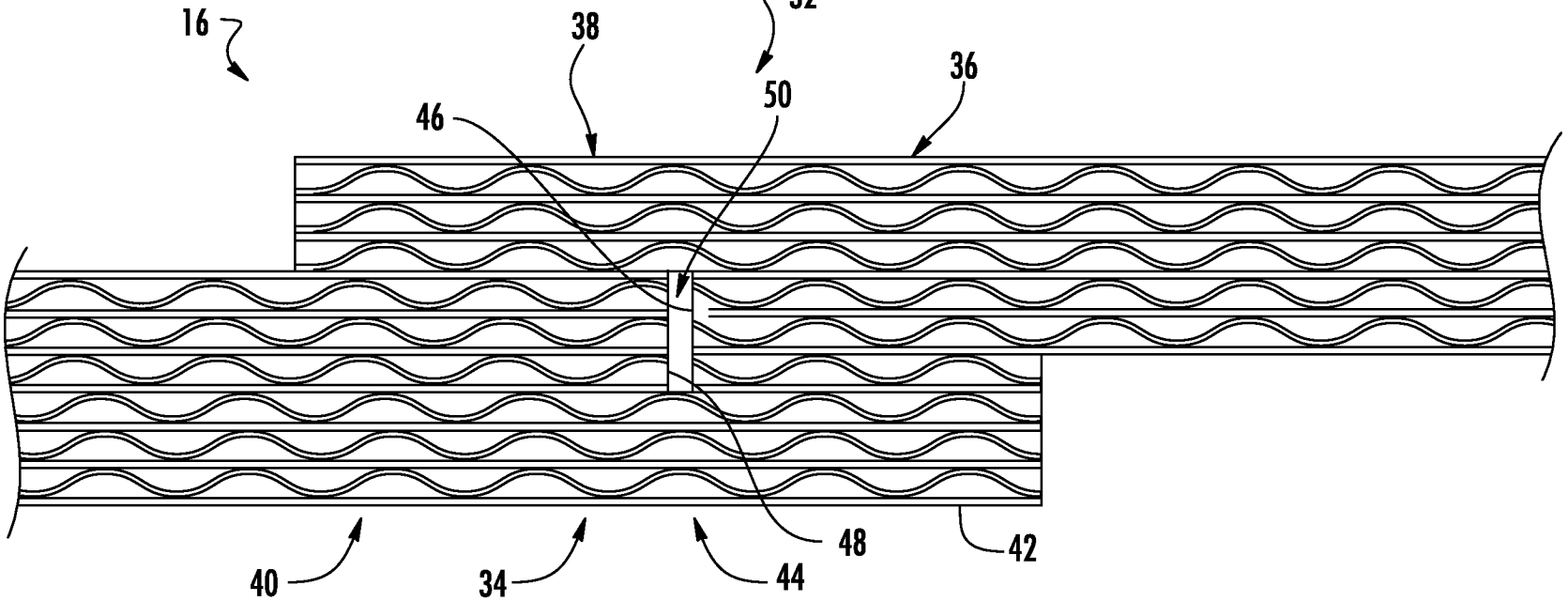
FIG. 3 illustrates a top elevation of the first side panel of the container of FIG. 1 after assembly.

Similarly, the second part 34 of the first side panel 16 also has a thick portion 40 and thin portion 42. The second part 34 of the first panel 16 is constructed in a manner similar to that of the first part 32; however, the thin portion 32 of the second part 34 of the first side panel 16 is an extension of the corrugation on the front of the long sheet 28 of cardboard. Accordingly, when the long sheet 28 of cardboard is folded, as shown in FIG. 1, the thin portion 38 of the first part 32 of the first side panel 16 overlaps and is adhesively secured to the thick portion 40 of the second part 34 of the first side panel 16, and the thin portion 42 of the second part 34 of the first side panel 16 overlaps and is adhesively secured to the thick portion 36 of the first part 32 of the first side panel 16. The result is a collapsible container 10 having three side panels 18, 20, 22 of a thickness of six corrugations and one side panel 16 having a thickness of six corrugations near the ends and a thickness of nine corrugations across the portion 44 of the first side panel 16 where the thin portions 38 and 42 overlap the thick portions 36 and 40 of the first part 32 and second part 34 of the first side panel 16. FIGS. 1-3.

As shown in FIG. 3, the end 46 of the thick portion 36 of the first part 32 of the first side panel 16 does not quite contact the end 48 of the thick portion 42 of the second part 34 of the first side panel 16 creating a gap 50. While the gap 50 is not required, the gap 50 allows the collapsible container 10 to be adjusted during assembly to account for variances in the tolerances of the die cuts and creases in the long sheet 28 of cardboard. If desired, the gap 50 may be eliminated and the thin portions 48, 42 lengthened or shortened, as desired.

Figure 4:
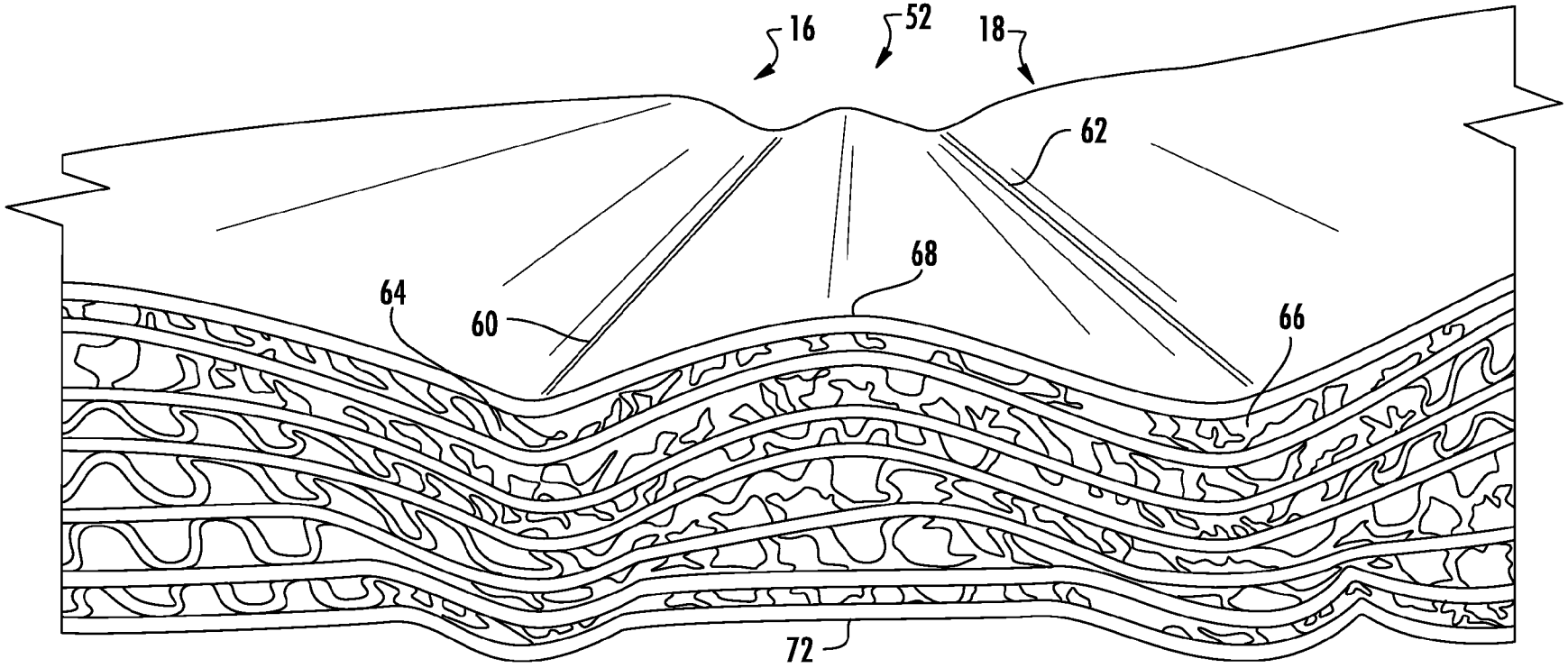
FIG. 4 illustrates a top perspective elevation of the first corner of the container of FIG. 1 prior to assembly.
Figure 5:
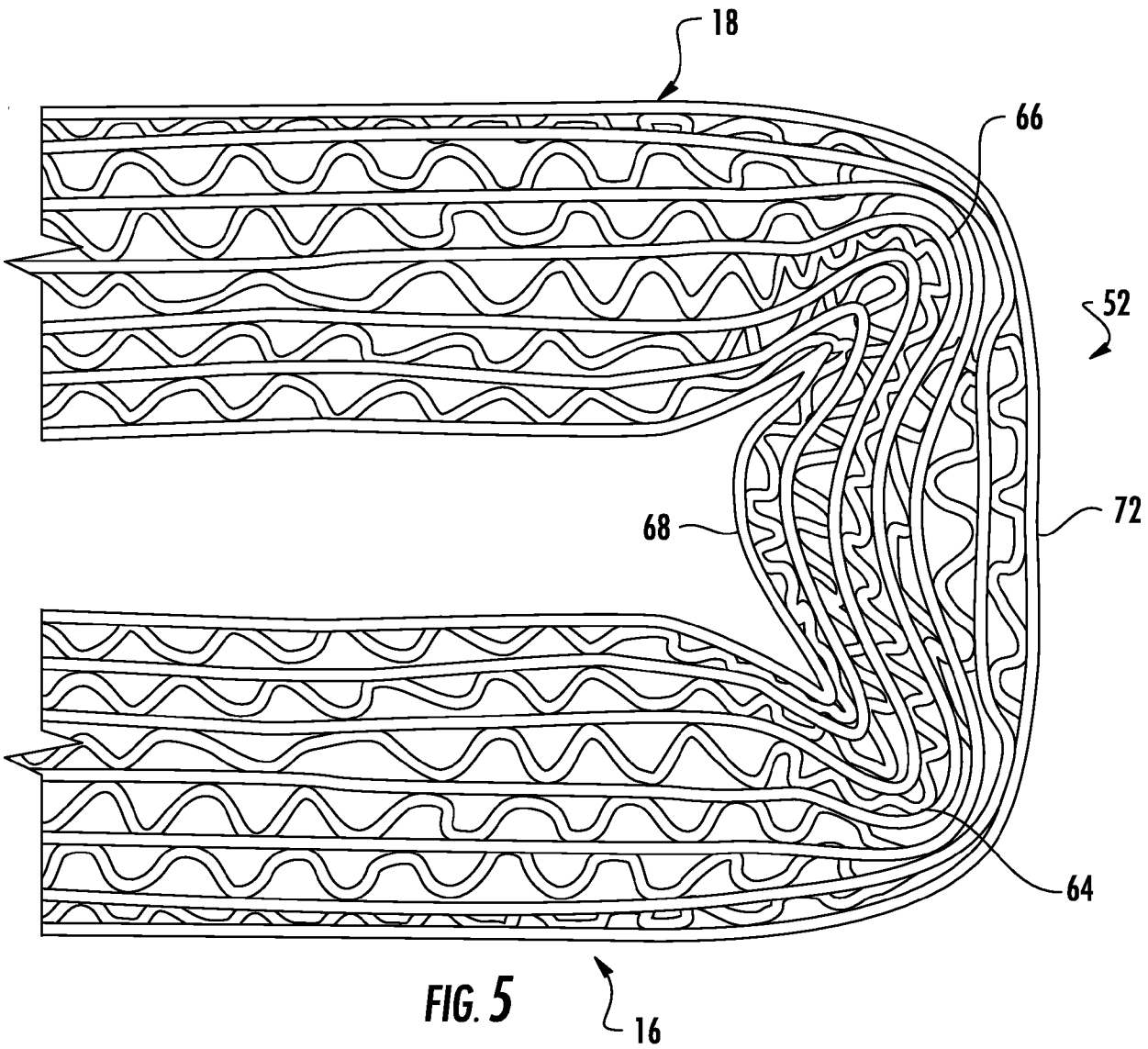
FIG. 5 illustrates a top perspective elevation of the first corner of the of the container of FIG. 1 over-folded for demonstration purposes.

As shown in FIG. 2, the container 10 is provided with four corners, 52, 54, 56, 58. As shown in FIGS. 2 and 4, the corner 52 is provided with two deep creases 60, 62. The creases can be formed with any type of manufacturer known in the art, but are preferably deep enough to compress the portions 64, 66 of the corner 52 below the creases to a thickness of less than 80% and more preferably less than 75% the thickness of the first side panel 16 (six corrugations). As shown in FIG. 4, the creases 60, 62 are applied a distance from one another greater than the minimum thickness of the first side panel (six corrugations) and less than four times the maximum thickness of the first side panel 16, more preferably less than three times the maximum thickness of the first side panel 16. The creases 60, 62 are applied in a manner that defines a substantially curved radius between the creases 60, 62. The curved radius 68 is on the interior 70 of the corner 52, while the exterior 72 of the corner 52 is substantially flat. Providing the corner 52 with two creases 60, 62 offset from the midline of the corner 52 allows the first side panel 16 and second side panel 18 to be folded to a position parallel to one another or even greater, as shown in FIG. 5. As shown in FIG. 5 despite the first side panel 16 and second side panel 18 being over-rotated toward a parallel position, they remain the exterior 72 of the first corner 52 remains substantially flat.

Figure 6:
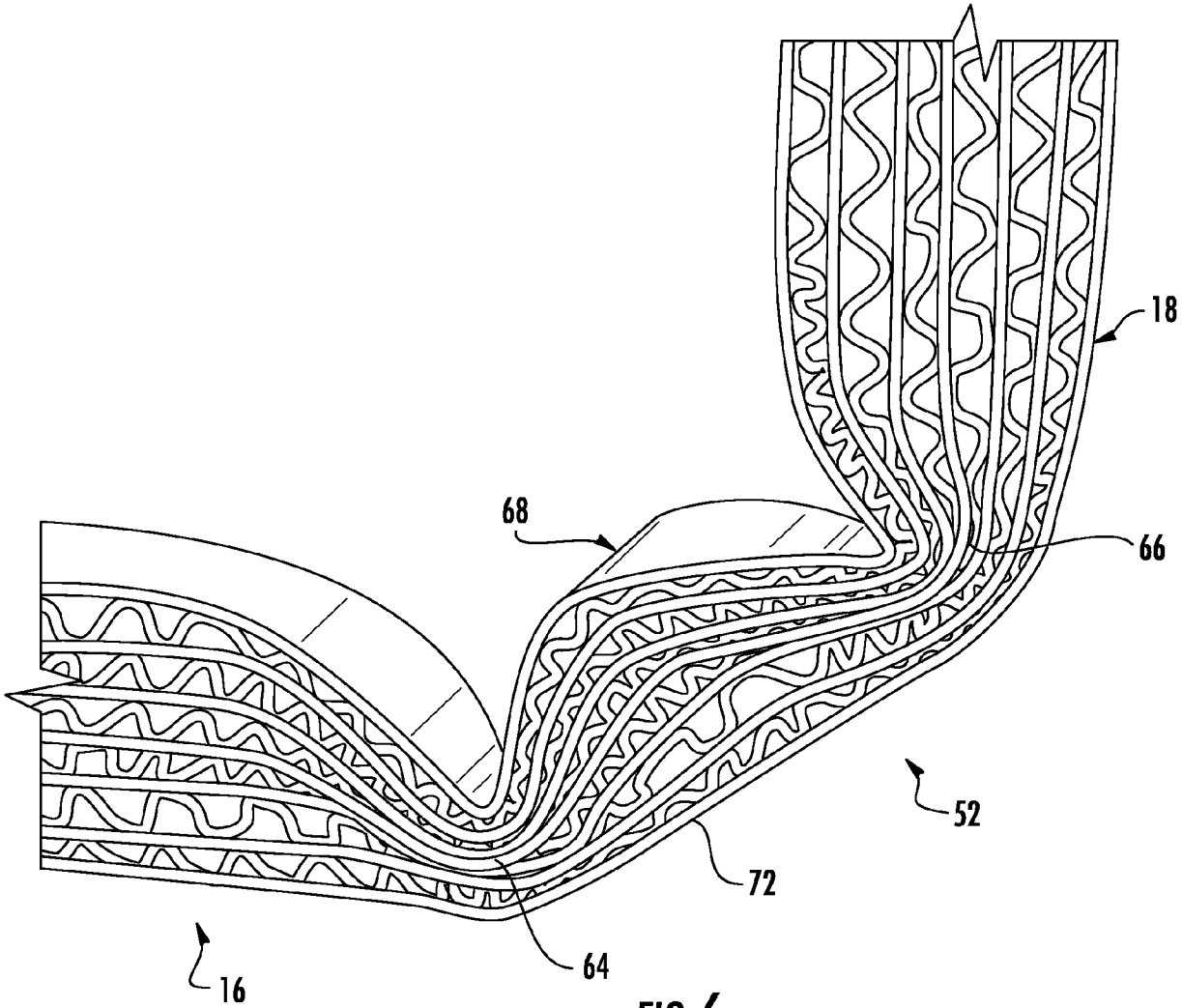
FIG. 6 illustrates a top perspective elevation of the first corner of the container of FIG. 1 after assembly.

As shown in FIG. 6, when the first side panel 16 is bent to a generally 90° angle relative to the second side panel 18 to construct the collapsible container 10, instead of the first corner 52 being a 90° transition, the first corner 52 is actually two 45° transitions at each of the creases 60, 62, creating a corner with a flat exterior 72 and a curved radius 68 along its interior 70, biasing the first side panel 16 and second side panel 18 inward toward one another or not biasing the side panels 16, 18 at all, as opposed to biasing the side panels 16, 18 toward an angle relative to one another greater than 90°. As shown in FIG. 2, the second corner 54 is also provided with a first crease 74 and second crease 76, defining a curved radius on the interior 78 of the corner and a flat surface on the exterior 80 of the corner. Similarly, the creases 82, 84 of the third corner 56 define a curved radius on the interior of the third corner 56 and a flat surface on the exterior 88 of the third corner. The creases 90, 92 of the fourth corner define a curved radius on the interior 94 of the fourth corner 58 and a flat surface on the exterior 96 of the fourth corner.

Accordingly, when the collapsible container is assembled as shown in FIG. 1, the tendency of the side panels 16, 18, 20, 22 to bow outward is eliminated or may even be reversed, giving the side panels 16, 18, 20, 22 a slight bias toward an inward compression to further offset the hydraulic forces associated with flowable material 98, a removable, flexible liner 100 is provided within the container 10. The flexible liner 100 is preferably constructed of polyethylene, such as that known in the art, to hold non-hazardous flowable material. Preferably, the liner 100 is provided with a nozzle 102 that extends through a circular cutout 104 provided in the fourth side panel 42 (FIGS. 1-2). Preferably, the nozzle 102 is provided with a collar in a manner, such as that known in the art, to prevent the nozzle 102 and collar 106 from passing through the cutout 104. The liner 100 is also preferably provided with a top cap 108. The opening in the collapsible container 10 allows a large fill head (not shown) to enter the collapsible container 10 coupled to the top cap 108 to fill the flexible liner 100. As the flexible liner 100 fills with flowable material 98, such as fruit juice concentrate, tomato paste, or the like, hydrostatic pressure forces the liner 100 against the side panels 16, 18, 20, 22 and downward against the bottom 14. This hydrostatic pressure presses firmly against the panels 112, 114, 116, 120 that make up the bottom 14 of the collapsible container 10 to prevent the panels from becoming dislodged, even if the panels are not frictionally interconnected with one another. The more flowable material 98 added to the liner 100, the greater the pressure on the panels 112, 114, 116, 118, 120 of the bottom 14 of the collapsible container 10, and the less likely it is that the panels will become dislodged from one another.

While the top 122 of the collapsible container 10 may become bowed slightly outward once the liner 100 has been filled with material, the unique construction of the corners 54, 56, 58 along with the increased thickness of the corrugation of the side panels 16, 18, 20, 22 prevent the side panels 16, 18, 20, 22 from bowing outward into a circular orientation. As shown in FIG. 1, once the liner 100 has been filled with flowable material 98, the top cap 108 is closed and the lid 24 is provided over the top 122 of the collapsible container. Although the lid 24 may be of any desired construction, in the preferred embodiment, the lid 24 is a piece of corrugated cardboard provided with side panels 126 angled downward to cover the side panels 16, 18, 20, 22. Once the lid 24 has been applied, the lid 24 may be adhesively secured to the side panels 16, 18, 20, 22, more preferably secured with adhesive tape. If desired, the container may be wrapped with film in a manner such as that known in the art. If desired, the lid 24 may be provided with any size opening to allow access to the top cap 150 by a fill head or any desired apparatus, even after the lid 24 has been secured over the collapsible container 10.

Although the invention has been described with respect to a preferred embodiment thereof, it is to be understood that it is not to be so limited since changes and modifications can be made therein which are within the full, intended scope of this invention as defined by the appended claims.

What is claimed is:

1. A collapsible container comprising:

(a) a first side panel, wherein the first panel is at least triple corrugated;

(b) a second side panel, wherein the second panel is at least triple corrugated;

(c) a third side panel, wherein the third panel is at least triple corrugated;

(d) a fourth side panel, wherein the fourth panel is at least triple corrugated;

(e) a first crease provided in the first side panel, wherein the first crease compresses the first side panel to a thickness of less than eighty percent of the greatest thickness of the first side panel;

(f) a second crease provided in the second side panel, wherein the second crease compresses the second side panel to a thickness of less than eighty percent of the maximum thickness of the second side panel;

(g) wherein the center of the first crease is located a predetermined distance from the center of the second crease, wherein the predetermined distance is greater than the minimum thickness of the first side panel and less than four times the maximum thickness of the first side panel; and (h) wherein the first side panel, the second side panel, the third side panel, and the fourth side panel define an interior of the collapsible container, wherein the first side panel and the second side panel are bowed toward the interior of the collapsible container.

2. The collapsible container of claim 1, wherein the first crease and the second crease define a peak there between.

3. The collapsible container of claim 2, wherein the maximum thickness of the peak is greater than the minimum thickness of the first crease and wherein the thickness of the peak is greater than the minimum thickness of the second crease.

4. The collapsible container of claim 3, wherein the maximum thickness of the peak is no greater than the maximum thickness of the first side panel and wherein the maximum thickness of the peak is no greater than the maximum thickness of the second side panel.

5. The collapsible container of claim 1, wherein the first crease and the second crease define a substantially curved radius there between.

6. The collapsible container of claim 1, further comprising a flexible bag provided within an interior defined by the first side panel, the second side panel, the third side panel, and the fourth side panel.

7. The collapsible container of claim 1, wherein the first side panel is secured to the fourth side panel.

8. The collapsible container of claim 1, further comprising:

(a) a third crease provided in the second side panel, wherein the third crease compresses the second side panel to a thickness of less than eighty percent of the greatest thickness of the second side panel;

(b) a fourth crease provided in the third side panel, wherein the second crease compresses the third side panel to a thickness of less than eighty percent of the maximum thickness of the third side panel; and (c) wherein the center of the third crease is located a supplemental predetermined distance from the center of the fourth crease, wherein the supplemental predetermined distance is greater than the minimum thickness of the second side panel and less than four times the maximum thickness of the second side panel.

9. The collapsible container of claim 8, wherein the first crease and the second crease define a first substantially curved radius there between, and wherein the third crease and the fourth crease define a second substantially curved radius there between.

10. A collapsible container comprising;

(a) a first side panel, wherein the first panel is at least triple corrugated;

(b) a second side panel, wherein the second panel is at least triple corrugated;

(c) a third side panel, wherein the third panel is at least triple corrugated;

(d) a fourth side panel, wherein the fourth panel is at least triple corrugated;

(e) a first crease provided in the first side panel; and (f) a second crease provided in the second side panel;

(g) wherein the first crease and the second crease define a corner section;

(h) wherein the corner section comprises:

(1) a first, substantially flat side; and (2) a second side defining a peak;

(h) wherein the first side panel, the second side panel, the third side panel, and the fourth side panel define an interior of the collapsible container, wherein the first side panel and the second side panel are bowed toward the interior of the collapsible container.

11. The collapsible container of claim 10, wherein the maximum thickness of the peak is greater than the minimum thickness of the first crease and wherein the thickness of the peak is greater than the minimum thickness of the second crease.

12. The collapsible container of claim 11, wherein the maximum thickness of the peak is no greater than the maximum thickness of the first side panel and wherein the maximum thickness of the peak is no greater than the maximum thickness of the second side panel.

13. The collapsible container of claim 10, wherein the maximum thickness of the peak is no greater than the maximum thickness of the first side panel and wherein the maximum thickness of the peak is no greater than the maximum thickness of the second side panel.

14. The collapsible container of claim 10, further comprising a flexible bag provided within an interior defined by the first side panel, the second side panel, the third side panel, and the fourth side panel.

15. The collapsible container of claim 10, wherein the first side panel is secured to the fourth side panel.

16. The collapsible container of claim 10, further comprising:

(a) a third crease provided in the second side panel;

(b) a fourth crease provided in the third side panel; and (c) wherein the third crease and the fourth crease define a supplemental peak there between.

17. The collapsible container of claim 16, wherein the first crease and the second crease define a first substantially curved radius there between, and wherein the third crease and the fourth crease define a second substantially curved radius there between.

18. A collapsible container comprising:

(a) a first side panel, wherein the first panel is at least triple corrugated;

(b) a second side panel, wherein the second panel is at least triple corrugated;

(c) a third side panel, wherein the third panel is at least triple corrugated;

(d) a fourth side panel, wherein the fourth panel is at least triple corrugated;

(e) a first crease provided in the first side panel, wherein the first crease compresses the first side panel to a thickness of less than eighty percent of the greatest thickness of the first side panel;

(f) a second crease provided in the second side panel, wherein the second crease compresses the second side panel to a thickness of less than eighty percent of the maximum thickness of the second side panel;

(g) wherein the first crease and the second crease define a substantially curved radius there between; and (h) wherein the first side panel, the second side panel, the third side panel, and the fourth side panel define an interior of the collapsible container, wherein the first side panel and the second side panel are bowed toward the interior of the collapsible container.

19. The collapsible container of claim 18, further comprising a flexible bag provided within an interior defined by the first side panel, the second side panel, the third side panel, and the fourth side panel.

20. The collapsible container of claim 18, wherein the first side panel is secured to the fourth side panel.

* * * * *